United States Patent [19]

Belvederi

[11] Patent Number: 4,883,076

[45] Date of Patent: Nov. 28, 1989

[54] DUAL-ROD CIGARETTE MANUFACTURING MACHINE

[75] Inventor: Bruno Belvederi, S.Martino di Monte S.Pietro, Italy

[73] Assignee: G.D Societa' per Azioni, Bologna, Italy

[21] Appl. No.: 265,142

[22] Filed: Oct. 31, 1988

[30] Foreign Application Priority Data

Nov. 3, 1987 [IT] Italy ..... 3678 A/87

[51] Int. Cl.[4] ..... A24C 5/18

[52] U.S. Cl. ..... 131/84.4; 131/84.1

[58] Field of Search ..... 131/84.1, 84.4

[56] References Cited

U.S. PATENT DOCUMENTS 4,304,243 12/1981 Seragnoli .

4,336,812 6/1982 Seragnoli .

*Primary Examiner*—V. Millin

*Attorney, Agent, or Firm*—Marshall, O'Toole, Gerstein, Murray & Bicknell

[57] ABSTRACT

On a dual-rod cigarette manufacturing machine, two tobacco beads retained by suction on parallel conveyor belts are subjected, prior to being wrapped in strips of cigarette paper, to the action of respective shaving devices, each comprising two tangent, coplanar, counter-rotating disks with cutting edges; the respective shafts of the disks on each shaving device being vertical and parallel with each other, and at least one of the disks having a circumference substantially equal to the length of a cigarette.

4 Claims, 3 Drawing Sheets

DUAL-ROD CIGARETTE MANUFACTURING MACHINE

BACKGROUND OF THE INVENTION

The present invention relates to a dual-rod cigarette manufacturing machine.

In particular, the present invention relates to the so-called shaving devices which, on such a machine, operate on the shredded tobacco beads prior to their being wrapped into so-called continuous cigarette rods.

Said machine, as described in U.S. Pat. No. 4,336,812 filed by the present Applicant, provides for forming two tobacco beads by accumulating single tobacco particles on the underside of respective supports consisting of parallel suction type conveyor belts.

As each tobacco bead is fed on the respective conveyor belt to cigarette forming means, it is subjected to a so-called shaving operation for substantially evening off its thickness.

On single-rod cigarette manufacturing machines, the so-called shavers by which this is done consist of two identical coplanar disks, mounted on vertical counter-rotating shafts, and having a circumference equal to a multiple of the cigarette length. Said disks are provided with cutting edges, and arranged tangent to each other along the path of the tobacco bead.

Shaving devices of the aforementioned type are too cumbersome for insertion on dual-rod cigarette manufacturing machines, on which the tobacco beads on the respective conveyors travel extremely close together, said distance being imposed by machine design and allowing of no adjustment. That is to say, if a shaving device of the aforementioned type were to be assigned to each tobacco bead, the disk inserted between the two conveyors would interfere with the second bead, thus preventing it from being fed to the cigarette forming means.

As described in U.S. Pat. No. 4,304,243 filed by the present Applicant, the shaving devices on dual-rod cigarette manufacturing machines therefore consist of pairs of identical truncated-cone disks mounted on inclined, downward-converging shafts. Said disks are arranged with the respective cutting edges on the wider end tangent to each other, and with their generating line aligned with the path of the respective tobacco bead. As such, the disks of each shaving device slope downwards from the point of contact with the respective tobacco bead, thus preventing the disk facing the second bead from interfering with the same.

Truncated-cone disks of the aforementioned type, however, have been found to pose serious grinding problems as compared with the flat types employed on single-rod cigarette manufacturing machines.

SUMMARY OF THE INVENTION

The aim of the present invention is to provide a shaving device for a dual-rod cigarette manufacturing machine, designed to operate efficiently and overcome the drawbacks typically associated with known shaving devices of the aforementioned type.

With this aim in view, according to the present invention, there is provided a dual-rod cigarette manufacturing machine comprising means for forming two continuous tobacco beads; two substantially parallel, coplanar conveyor belts for transferring said beads to an unloading station; and, along the path of each said conveyor, a shaving device for shaving one said tobacco bead, and consisting of a first and second counter-rotating disk arranged respectively inside and outside the space between said beads, said disks having a cutting edge and being arranged with the respective said edges substantially tangent along the path of the respective said bead, the shafts of said disks lying in a plane substantially perpendicular to the travelling direction of said tobacco beads; characterised by the fact that, on each said shaving device, the diameter of said first disk is approximately equal to the distance between said tobacco beads.

BRIEF DESCRIPTION OF THE DRAWINGS

The present invention will be described, by way of example, with reference to the accompanying drawings, in which.

DETAILED DESCRIPTION OF THE INVENTION

Figure 1:
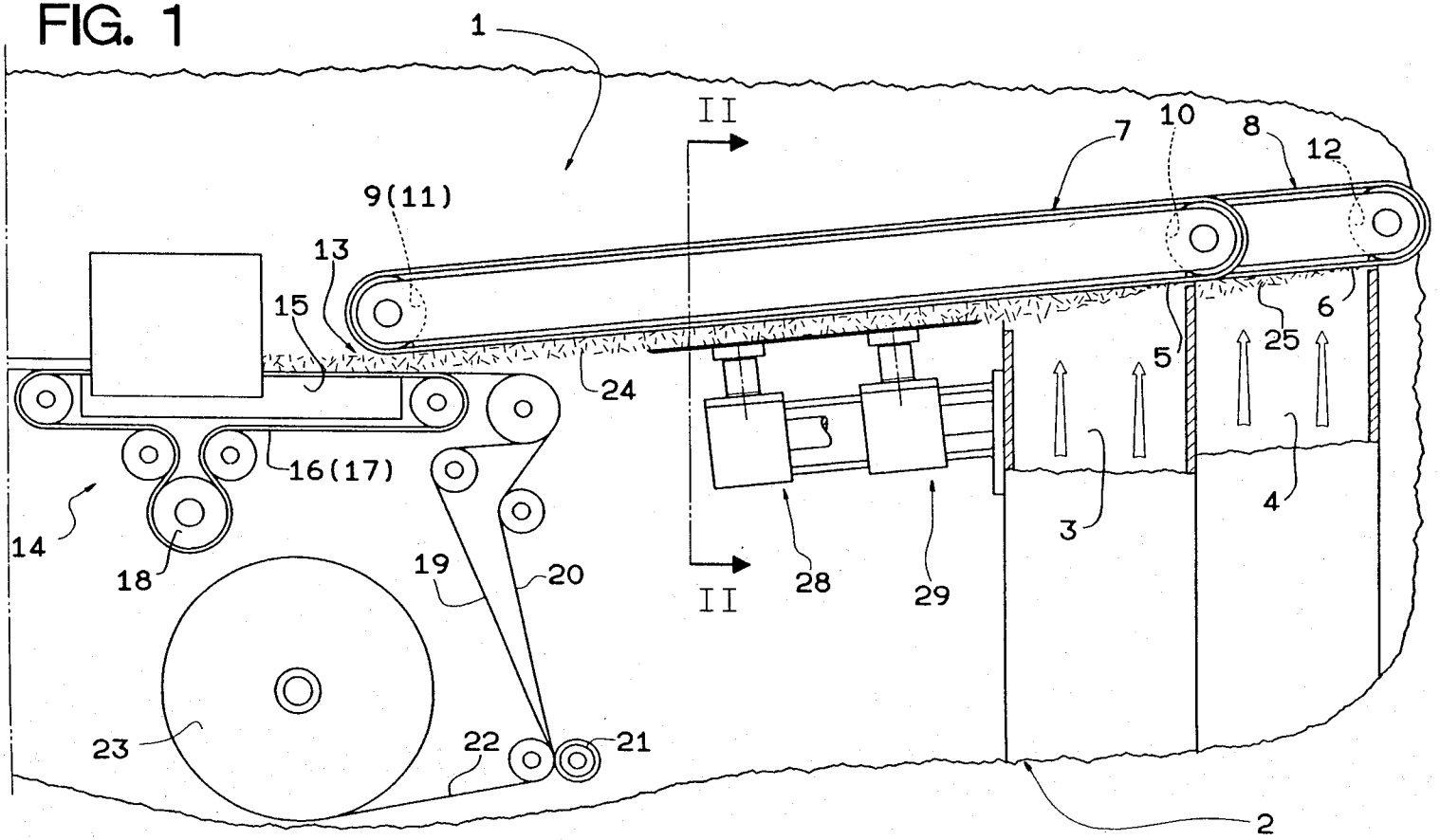
FIG. 1 shows a schematic view of a dual-rod cigarette manufacturing machine in accordance with the teachings of the present invention.

Number 1 in FIG. 1 indicates the bed of a dual-rod cigarette manufacturing machine indicated as a whole by 2. Numbers 3 and 4 indicate two ducts, the bottom ends of which are fed, by means not shown, with a continuous stream of tobacco particles.

By virtue of an upward air current generated by a suction source not shown, said particles are forced up ducts 3 and 4 on to the bottom branches 5 and 6 of respective suction type conveyor belts 7 and 8 looped about respective end rollers 9, 10 and 11, 12. Coaxial end rollers 9 and 11 are powered to turn clockwise (FIG. 1) and located lower down than rollers 10 and 12, so that said bottom branches 5 and 6 slope downwards in the travelling direction.

Bottom branches 5 and 6 close off the outlets of ducts 3 and 4, and extend leftwards up to a so-called unloading station 13 wherein the tobacco is fed to section 14 of machine 2. Said unloading station 13 is situated at the confluence of bottom branches 5 and 6 with the top branches, running over horizontal surface 15, of two belts 16 and 17 (only one of which is shown in FIG. 1) looped about, and powered by, an anticlockwise-rotating roller 18.

Numbers 19 and 20 indicated two strips of cigarette paper produced by a cutting disk 21 longitudinally cutting a strip 22 fed of reel 23.

Ducts 3 and 4 constitute the means whereby to accumulate tobacco particles and so form a continuous tobacco bead 24, 25 on suction conveyor branch 5, 6 respectively (Fig. 2), which beads 24, 25 are fed, at unloading station 13, on to paper strips 19 and 20 respectively.

As they run along surface 15, strips 19 and 20 are wrapped gradually, by guide means not shown, about tobacco beads 24 and 25, so as to form two continuous cigarette rods, which are subsequently cut into single cigarettes by a cutting device not shown.

Outside ducts 3 and 4 (FIG. 2) and upstream from unloading station 13, tobacco beads 24 and 25 are retained by suction on to respective branches 5 and 6, and confined laterally by respective walls 26 and 27 beneath which two respective shaving devices 28 and 29 operate on the bottom portion of beads 24 and 25.

Figure 2:
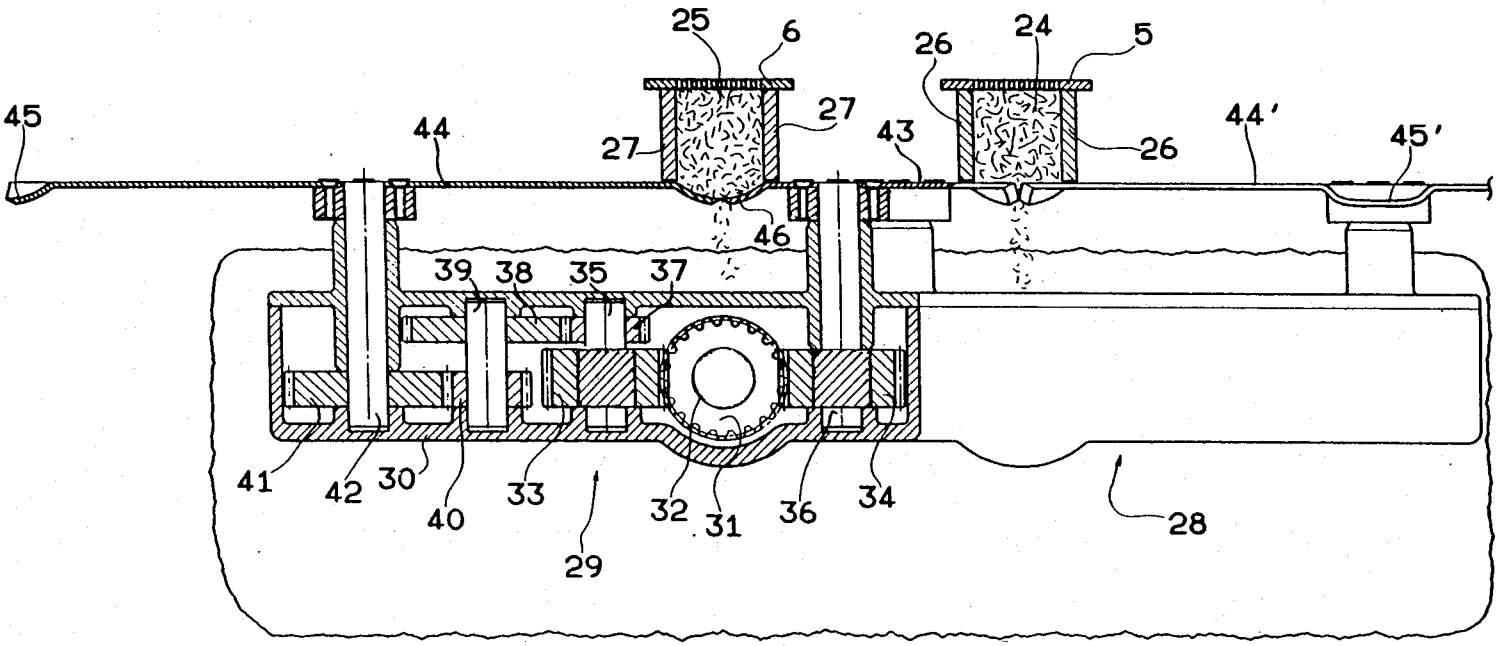
FIG. 2 shows a larger-scale section along line II—II in FIG. 1 of two shaving devices forming part of the FIG. 1 machine.

As shaving devices 28 and 29 are identical, the following description will be limited to device 29, the corresponding component parts on device 28 being indicated in FIG. 2 using the same numbering system plus a (').

Shaving device 29 comprises a casing 30 supported on bed 1 of machine 2 and housing a gear 31 fitted on to a horizontal shaft 32 connected via transmission means (not shown) to drive means (not shown) on machine 2. Gear 31 meshes with two gears 33, 34 fitted on to the respective bottom ends of two vertical shafts 35, 36 lying in a plane substantially perpendicular to the travelling direction of tobacco bead 24.

The upper portion of shaft 35 is fitted with a gear 37 meshing with a gear 38 fitted on to the top end of shaft 39 parallel with shaft 35. The bottom end of shaft 39 is fitted with a gear 40 meshing with a gear 41 fitted on to the bottom end of a shaft 42 parallel with shaft 36. The axes of shafts 42 and 36 lie in a vertical plane perpendicular to the travelling direction of tobacco bead 25.

The top ends of shafts 35 and 42, outside casing 30, are fitted with two coplanar, counter-rotating disks 43, 44 having a peripheral cutting edge and arranged tangent to each other along the path of tobacco bead 25.

Figure 3:
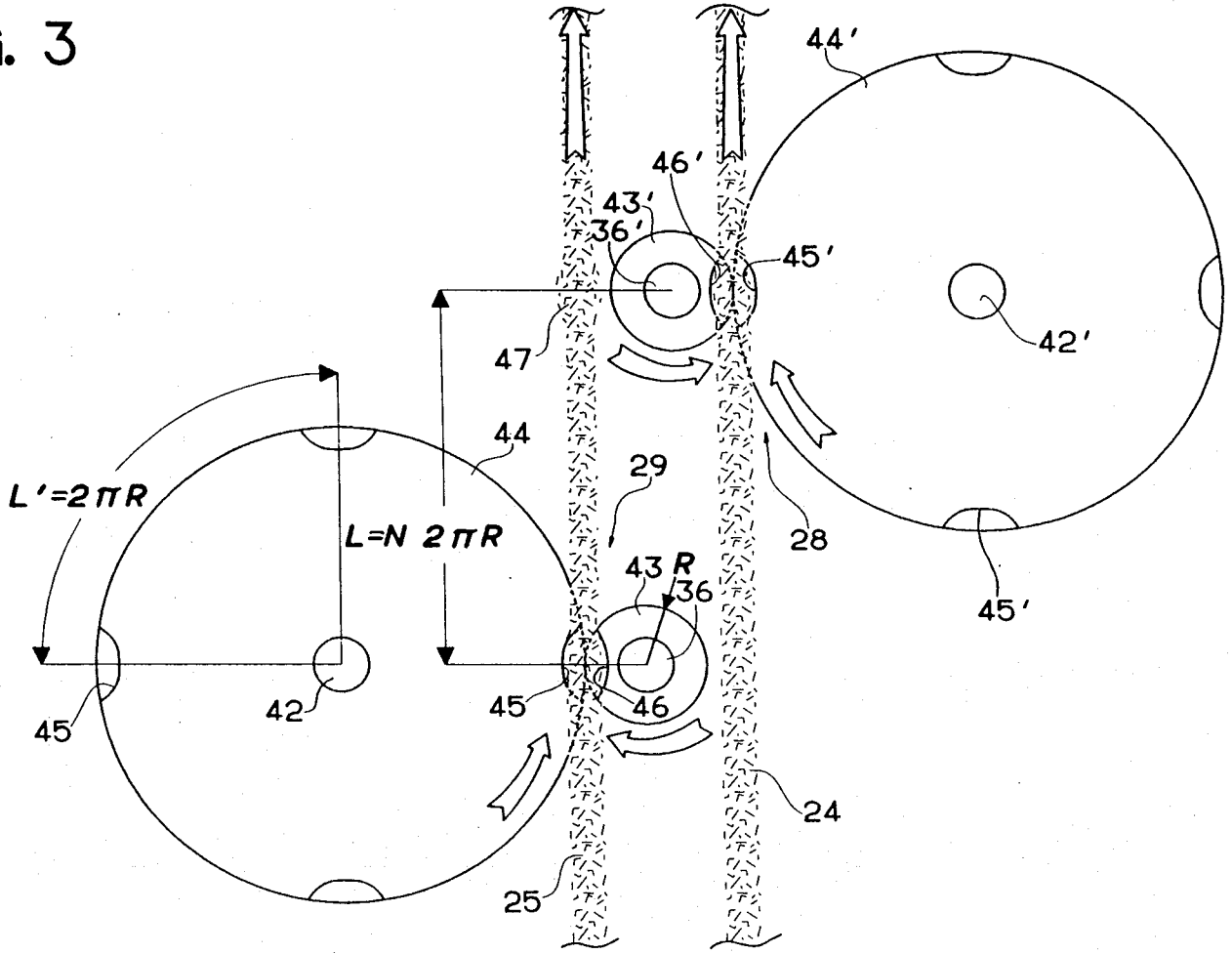
FIG. 3 shows a plan view of the shaving devices according to the present invention.

The radius R of disk 43 is such that the circumference of disk 43 is substantially equal to the length of a cigarette, whereas the circumference of disk 44 is equal to a multiple of the cigarette length (four times said length in the FIG. 3 example). Gears 33, 37, 38, 40 and 41 are sized so that the peripheral speeds of disks 43 and 44 are the same.

Disk 44 presents four equally-spaced peripheral grooves 45 which, during operation of shaving device 29, mate successively with a groove 46 on the peripheral surface of disk 43. The spacing of grooves 45 is equal to the length of a cigarette.

By virtue of the combined action of disks 43 and 44 featuring grooves 46 and 45, tobacco bead 25 is formed so as to present portions of substantially uniform thickness alternating with thicker portions 47 at intervals equal to the length of a cigarette.

Subsequent to the formation of said continuous cigarette rods by wrapping beads 25 and 24 in respective paper strips 20 and 19, said thicker portions 47 are cut to produce cigarettes equal to said interval and packed more firmly at the ends as compared with the intermediate portion. Said tightly-packed portions are known to produce cigarettes with compact end portions better suited to withstand subsequent processing (filter assembly and packing) with little or no tobacco loss.

As on known devices featuring truncated-cone disks, disks 43' and 43 of shaving devices 28 and 29 inserted between tobacco beads 24 and 25 therefore present a diameter roughly equal to the distance between beads 24 and 25, and are arranged in such a manner as to in no way interfere with the path of the second tobacco bead 24, 25. By virtue of the circumference of disks 43 and 43' being equal to the length of a cigarette, said disks 43 and 43' are compact enough to be inserted inside the space between tobacco beads 24 and 25. Furthermore, the flat design of disks 43, 44, 43' and 44'0 provides for troublefree grinding, thus overcoming the drawbacks typically associated with the truncated-cone disks employed on known types of dualrod cigarette manufacturing machines.

I claim:

1. A dual-rod cigarette manufacturing machine (2) comprising:

means (3,4) for forming two continuous tobacco beads (24,25);

two substantially parallel, coplanar conveyor belts (5,6) for transferring the two beads (24,25) to an unloading station (13);

a pair of shaving devices (28,29);

one of the pair of shaving devices (28,29) being positioned along the path of each of the conveyor belts (5,6), for shaving a tobacco bead (24,25) transferred by the belt;

each shaving device comprising a pair of first and second counter-rotating disks (43, 44; 43', 44') arranged respectively inside and outside the said bead (24,25) and each disk being mounted on a shaft;

each disk having a cutting edge and being arranged with the respective cutting edges substantially tangent along the path of the respective bead (24,25);

the shafts of the disks (43, 44; 43', 44') lying in a plane substantially perpendicular to the traveling direction of the tobacco beads (24,25); and the diameter of the first disk (43,43') of each shaving device (28,29) is approximately equal to the distance between the two tobacco beads (24,25).

2. A cigarette manufacturing machine as claimed in claim 1, characterised by the fact that at least said first disk (43,43') presents a circumference substantially equal to the length of a cigarette.

3. A cigarette manufacturing machine as claimed in claim 2, characterised by the fact that said second disk (44, 44') presents a circumference equal to a multiple of the cigarette length.

4. A cigarette manufacturing machine as claimed in claim 3, characterised by the fact that, on each said shaving device (28, 29), said first disk (43, 43') presents a peripheral groove (46), and said second disk (44, 44') presents a number of equally-spaced peripheral grooves (45) designed to mate successively with said groove (46) on said first disk (43, 43') as said disks (43, 44; 43', 44') are rotated.

* * * * *